US011571888B2

(12) United States Patent
Uchida

(10) Patent No.: US 11,571,888 B2
(45) Date of Patent: Feb. 7, 2023

(54) EJECTION APPARATUS AND EJECTION SPEED ACQUISITION METHOD

(71) Applicant: CANON KABUSHIKI KAISHA, Tokyo (JP)

(72) Inventor: Naoki Uchida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 60 days.

(21) Appl. No.: 17/362,021

(22) Filed: Jun. 29, 2021

(65) Prior Publication Data

US 2022/0001665 A1 Jan. 6, 2022

(30) Foreign Application Priority Data

Jul. 2, 2020 (JP) ..... JP2020-115059

(51) Int. Cl.
*B41J 2/045* (2006.01)
*B41J 2/21* (2006.01)

(52) U.S. Cl.
CPC ..... *B41J 2/04561* (2013.01); *B41J 2/04573* (2013.01); *B41J 2/2135* (2013.01)

(58) Field of Classification Search
CPC ... B41J 2/04561; B41J 2/04573; B41J 2/2135
See application file for complete search history.

(56) References Cited

U.S. PATENT DOCUMENTS

2002/0027575 A1 3/2002 Bruch
2004/0095410 A1 5/2004 Miyashita
2017/0144433 A1 5/2017 Ohnishi
2020/0230951 A1* 7/2020 Kobayashi ..... B41J 19/145

FOREIGN PATENT DOCUMENTS

JP 2007152853 A 6/2007

* cited by examiner

*Primary Examiner* — Thinh H Nguyen
(74) *Attorney, Agent, or Firm* — Canon U.S.A., Inc. I.P. Divsion

(57) ABSTRACT

An ejection apparatus includes an ejection head configured to eject a droplet from an ejection port on an ejection port surface, a droplet detection unit configured to detect arrival of the droplet ejected from the ejection port at a predetermined position, an acquisition unit configured to acquire information about an ejection speed that is a moving speed of the droplet detected by the droplet detection unit, and a determination unit configured to determine subsequent timings for acquiring an ejection speed by the acquisition unit, based on the ejection speed acquired by the acquisition unit at a preceding timing of the subsequent timings.

16 Claims, 12 Drawing Sheets

FIG.11A

| n | DOT COUNT | ESTIMATED SPEED [m/s] |
|---|---|---|
| | 0 | 10 |
| 1 | 0.5 × 10e8 | 9.7 |
| 2 | 1 × 10e8 | 9.4 |
| 3 | 1.8 × 10e8 | 9.1 |
| 4 | 3 × 10e8 | 8.8 |
| ⋮ | ⋮ | ⋮ |

FIG.11B

| n | DOT COUNT | ESTIMATED SPEED [m/s] |
|---|---|---|
| | 0 | 10 |
| 1 | 0.5 × 10e8 | 9.7 |
| 2 | 0.75 × 10e8 | 9.4 |
| 3 | 1.2 × 10e8 | 9.1 |
| 4 | 1.8 × 10e8 | 8.8 |
| ⋮ | ⋮ | ⋮ |

FIG.11C

| n | SPEED TO BE CALCULATED AT TIMING STORED IN TABLE BASED ON CALCULATED SPEED |
|---|---|
| | 10 |
| 1 | 9.6 |
| 2 | 9.2 |
| 3 | 8.8 |
| 4 | 8.4 |
| ⋮ | ⋮ |

EJECTION APPARATUS AND EJECTION SPEED ACQUISITION METHOD

BACKGROUND

Field of the Disclosure

The present disclosure relates to an ejection apparatus and an ejection speed acquisition method.

Description of the Related Art

In inkjet printing apparatuses, ejection speeds of ink droplets can change depending on individual differences of printing apparatuses and printheads, physical properties of ink, and the use status and environmental impacts after a long use. If ejection speeds of ink droplets change, a landing position of an ink droplet ejected in a forward direction and a landing position of an ink droplet ejected in a backward direction are misaligned, for example, when an image is printed by reciprocating scanning of a printhead. This causes deterioration in image quality.

Japanese Patent Application Laid-Open No. 2007-152853 discusses a registration adjustment method in which an optical detector for measuring an ejection speed of ejected ink is provided and an appropriate ejection timing is set in accordance with a movement speed and an ejection speed of a printhead, based on the measurement result. This document also discusses a configuration in which an ejection speed for a registration adjustment is measured based on the accumulated times of ink ejected from each nozzle.

However, in a case where an interval between ejection speed measurements is, for example, too short, since an ejection speed measurement is frequently performed, the user convenience can be reduced. In a case where the interval is too long, since recording is performed using an adjustment value of a previously set ejection timing despite a decrease in the ejection speed, an ink droplet landing positions can be misaligned, which affects image quality.

SUMMARY

The present disclosure addresses the above-described issue and aspects provide appropriate setting of a timing for acquiring an ejection speed.

According to an aspect of the present disclosure, an ejection apparatus includes an ejection head configured to eject a droplet from an ejection port on an ejection port surface, a droplet detection unit configured to detect arrival of the droplet ejected from the ejection port at a predetermined position, an acquisition unit configured to acquire information about an ejection speed that is a moving speed of the droplet detected by the droplet detection unit, and a determination unit configured to determine subsequent timings for acquiring information about an ejection speed by the acquisition unit, based on the ejection speed acquired by the acquisition unit at a preceding timing of the subsequent timings.

Further features of the present disclosure will become apparent from the following description of exemplary embodiments with reference to the attached drawings.

BRIEF DESCRIPTION OF THE DRAWINGS

FIGS. 11A, 11B, and 11C are tables each illustrating timings for executing the ejection speed calculation processing.

DESCRIPTION OF THE EMBODIMENTS

<Overall Summary of Printing Apparatus>

Figure 1:
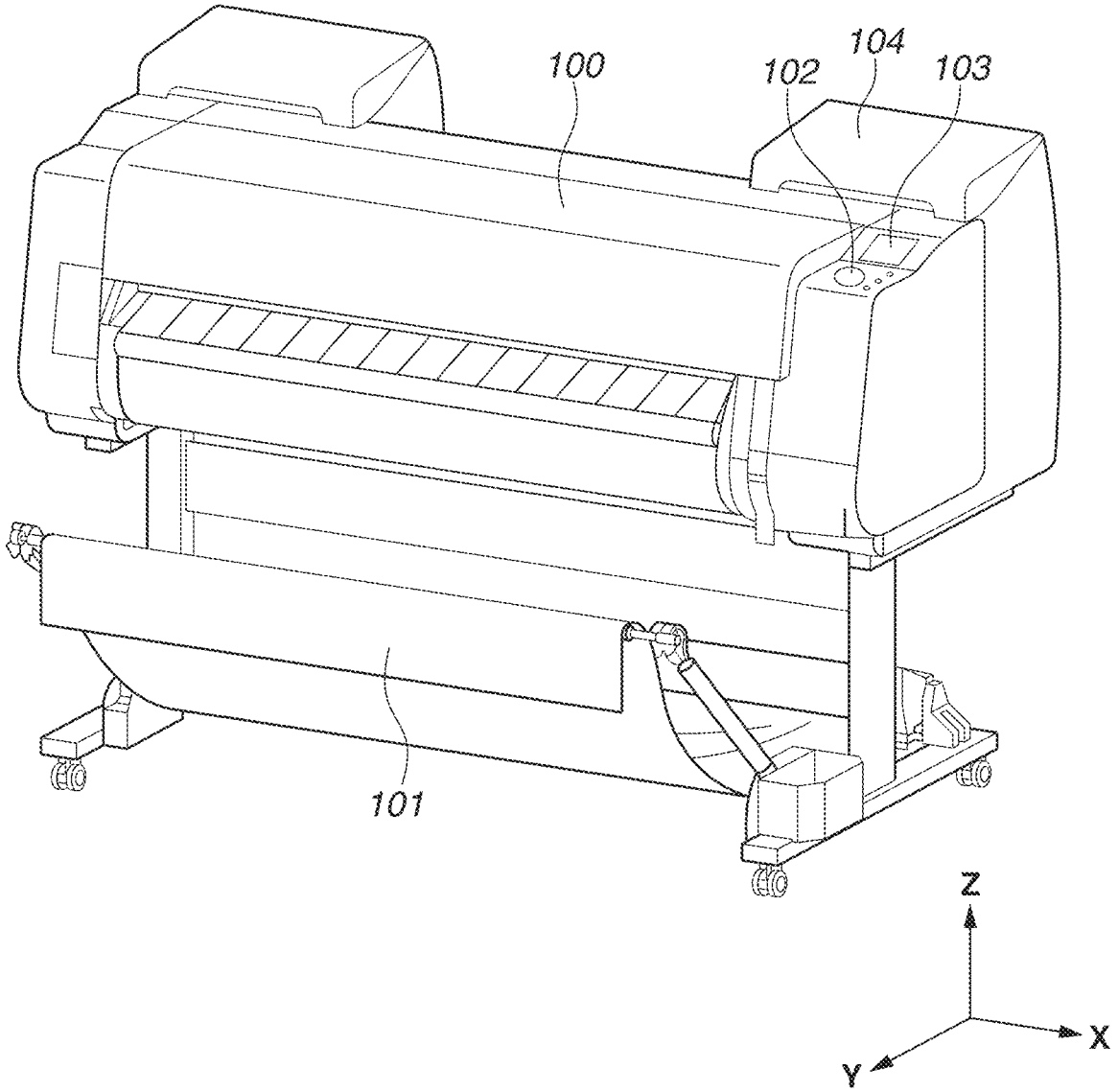
FIG. 1 is a diagram illustrating an appearance of a printing apparatus according to an exemplary embodiment.

FIG. 1 is a view illustrating an appearance of an inkjet printing apparatus (hereinafter referred to as a printing apparatus) 100 as an example of a droplet ejection apparatus according to a first exemplary embodiment.

The printing apparatus 100 illustrated in FIG. 1 includes a discharge guide 101 on which an output recording medium is stacked, a display panel 103 for displaying various printing information, setting results, and the like, and an operation button 102 for setting a printing mode, a recording sheet, and the like. The printing apparatus 100 further includes an ink tank unit 104 that accommodates ink tanks for storing ink of colors, such as black, cyan, magenta, and yellow, and supplies ink to a printhead 201 (FIG. 2) which is an example of a droplet ejection head. The printing apparatus 100 illustrated in FIG. 1 is a printing apparatus capable of printing images on recording media with various widths up to a 60-inch recording medium. Roll paper and cut paper can be used as a recording medium 203. The recording medium 203 is not limited to paper, but instead may be, for example, cloth or plastic.

Figure 2:
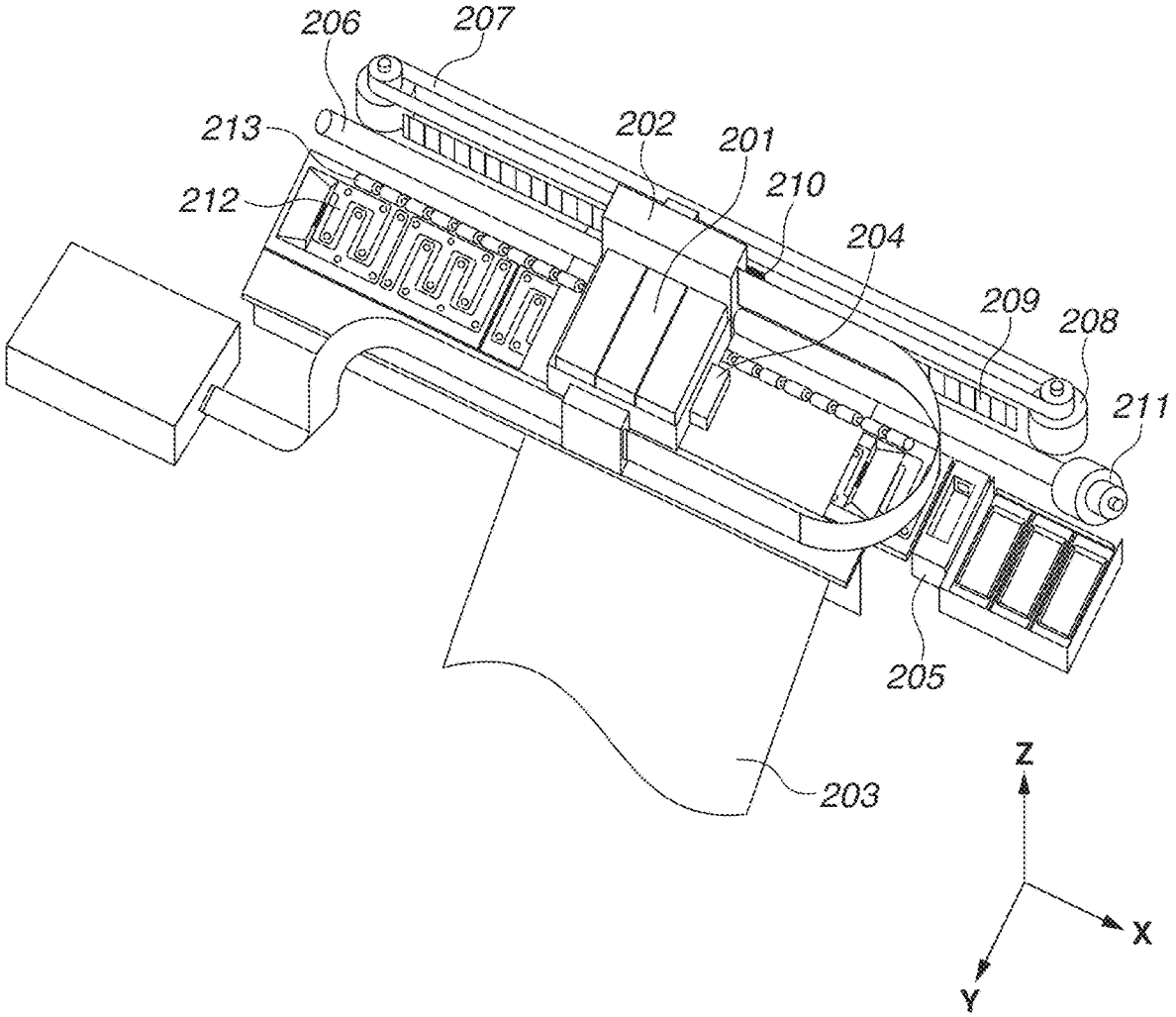
FIG. 2 is a perspective view illustrating an internal configuration of the printing apparatus according to the exemplary embodiment.
Figure 5A:
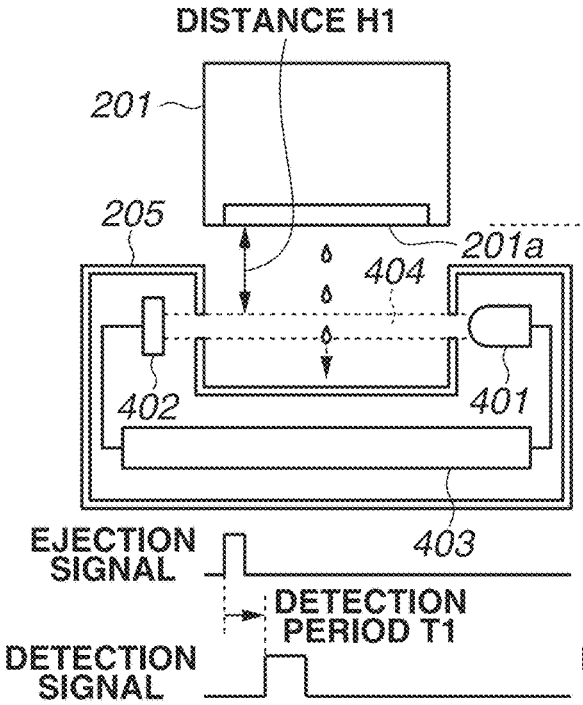
FIGS. 5A, 5B, 5C, and 5D are diagrams illustrating an ink droplet ejection speed calculation method according to the exemplary embodiment.

FIG. 2 is a perspective view illustrating an internal configuration of the printing apparatus 100. A platen 212 is a member for supporting the recording medium 203 located at a position facing the printhead 201. The recording medium 203 is supported by the platen 212 and conveyed in a conveyance direction (Y-direction) by a sheet conveyance roller 213. The printhead 201 includes an ejection port surface 201*a* (FIG. 5A) on which an ejection port is formed. On the ejection port surface 201*a*, an ejection port row in which a plurality of ejection ports is arranged in the Y-direction for each ink color, and the ejection port rows are arranged in an X-direction. The printhead 201 is mounted on a carriage 202. The printhead 201 also includes a distance detection sensor 204 for detecting a distance between the printhead 201 and the recording medium 203 on the platen 212. The distance detection sensor 204 includes a light-emitting element that irradiates the recording medium 203 with light, and a light-receiving element that receives light reflected from the recording medium 203. The distance detection sensor 204 is an optical sensor for measuring a distance based on a change in output of an amount of light received by the light-receiving element. A droplet detection sensor 205 is a sensor for detecting a droplet ejected from the printhead 201. In the present exemplary embodiment, the droplet detection sensor 205 is a sensor for detecting an ink droplet. The droplet detection sensor 205 is an optical sensor including a light-emitting element 401 (FIG. 5A) as a light emitting unit for emitting light, a light-receiving element 402 (FIG. 5A) as a light receiving unit for receiving light, and a control circuit board 403 (FIG. 5A). This configuration will be described in detail with reference to FIGS. 5A to 5D. While the optical sensor is used as the droplet detection sensor 205 that detects an ink droplet, other type of sensor can be used if the sensor can detect an ink droplet arriving at a predetermined position. A main rail 206 supports the carriage 202 and the carriage 202 performs reciprocating scanning in the X-direction (direction orthogonal to the recording medium conveyance direction) along the main rail 206. The carriage 202 performs scanning when a carriage conveyance belt 207 is driven by driving of a carriage motor 208. A linear scale 209 is disposed in a scanning direction and an encoder sensor 210 mounted on the carriage 202 detects the linear scale 209 to acquire positional information. The printing apparatus 100 further includes a lift cam (not illustrated) for causing the height of the main rail 206 supporting the carriage 202 to be varied in stages, and a lift motor 211 for driving the lift cam. The lift motor 211 drives the lift cam to cause the printhead 201 to ascend or descend and thus to cause the printhead 201 and the recording medium 203 to approach each other or to be spaced apart from each other. The height of the main rail 206 can be varied in multiple stages with a predetermined accuracy based on a position where the lift cam is stopped, and the variable amount of the height is changed relatively to a height corresponding to a predetermined stage. Thus, the variable distance between stages can be set with high accuracy.

Figure 3:
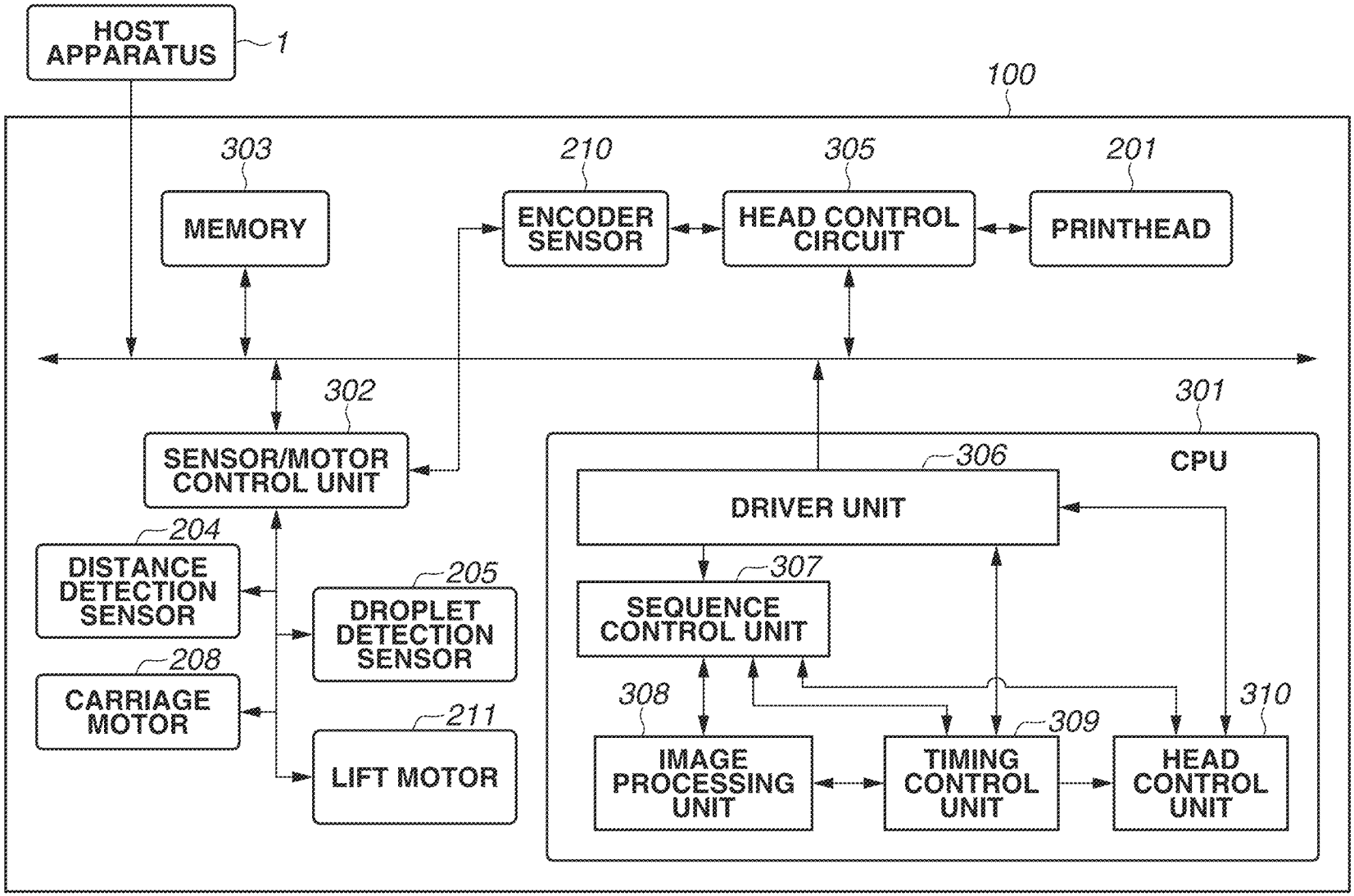
FIG. 3 is a block diagram illustrating a control configuration of the printing apparatus according to the exemplary embodiment.

FIG. 3 is a block diagram illustrating a control configuration of the printing apparatus 100. The printing apparatus 100 includes a central processing unit (CPU) 301 that controls the overall operation of the printing apparatus 100, a sensor/motor control unit 302 that controls sensors and motors, and a memory 303 that stores various information about an ejection speed and a thickness of each recording medium 203. The CPU 301, the sensor/motor control unit 302, and the memory 303 are connected to each other to communicate with each other. The sensor/motor control unit 302 controls the distance detection sensor 204, the droplet detection sensor 205, and the carriage motor 208 for scanning the carriage 202. The sensor/motor control unit 302 controls a head control circuit 305 based on the positional information detected by the encoder sensor 210, and causes the printhead 201 to eject ink.

Image data transmitted from a host apparatus 1 is converted into an ejection signal by the CPU 301, and ink is ejected from the printhead 201 according to the ejection signal, to perform printing on the recording medium 203. The CPU 301 includes a driver unit 306, a sequence control unit 307, an image processing unit 308, a timing control unit 309, and a head control unit 310. The sequence control unit 307 controls the overall printing control operation. Specifically, for example, the sequence control unit 307 controls the functional blocks, including the image processing unit 308, the timing control unit 309, and the head control unit 310, to be started and stopped, controls the conveyance of the recording medium 203, and controls scanning by the carriage 202. The functional blocks are controlled such that the sequence control unit 307 reads out various programs from the memory 303 and executes the programs. The driver unit 306 generates a control signal that is transmitted to the sensor/motor control unit 302, the memory 303, the head control circuit 305, and the like, based on an instruction from the sequence control unit 307, and transmits an input signal from each of the functional blocks to the sequence control unit 307.

The image processing unit 308 performs color separation/conversion processing on the image data input from the host apparatus 1, and performs image processing for converting the image data into print data based on which printing can be performed by the printhead 201. The timing control unit 309 transfers the print data converted and generated by the image processing unit 308 to the head control unit 310 in conjunction with the position of the carriage 202. The timing control unit 309 also controls a print data ejection timing. This timing control is performed according to the ejection timing determined based on an ejection speed calculated in ejection speed calculation processing to be described below. The head control unit 310 functions as an ejection signal generation unit. The head control unit 310 converts the print data input from the timing control unit 309 into an ejection signal and outputs the ejection signal. The head control unit 310 also controls the temperature of the printhead 201 by outputting a control signal at a level that is not enough to cause ink ejection, based on an instruction from the sequence control unit 307. The head control circuit 305 functions as a driving pulse generation unit. The head control circuit 305 generates a driving pulse according to the ejection signal input from the head control unit 310 and applies the generated driving pulse to the printhead 201.

Figure 4A:
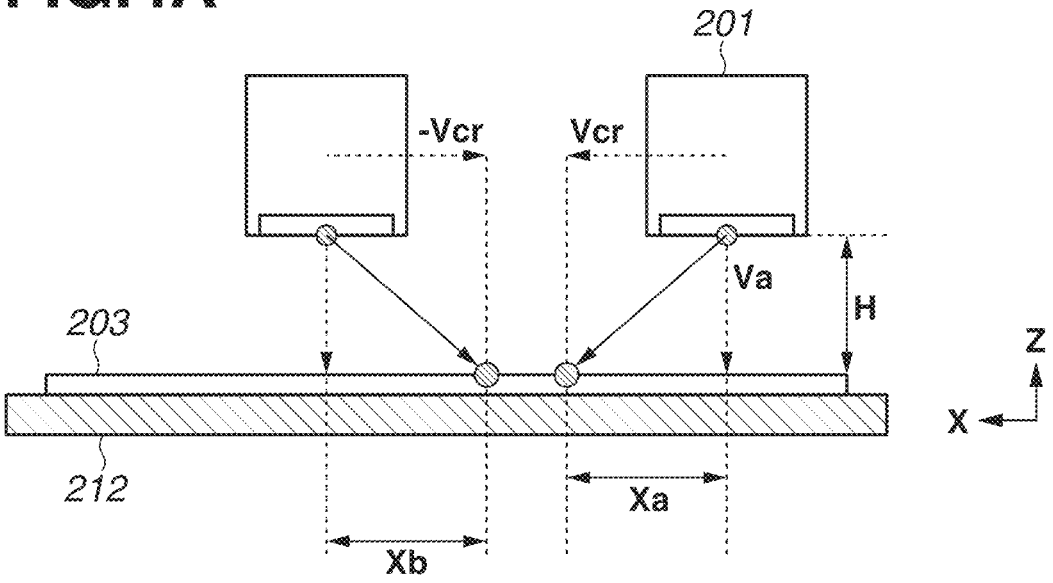
FIGS. 4A and 4B are schematic diagrams illustrating a correlation between an ejection speed and a landing position of an ink droplet.

Next, ejection timing adjustment processing will be described with reference to FIGS. 4A and 4B. FIG. 4A is a schematic diagram illustrating a relationship between an ejection speed and a landing position of an ink droplet. A distance between the ejection port surface 201*a* of the printhead 201 and the recording medium 203 in a Z-direction is represented by H. The printhead 201 ejects ink while performing reciprocating scanning at a scanning speed Vcr in the X-direction, to print an image on the recording medium 203. An ejection speed of an ink droplet ejected from the printhead 201 is represented by Va. As illustrated in FIG. 4A, since a direction of forward scanning is different from a direction of backward scanning, landing positions of ink relative to respective ink droplet ejected positions varies. To align land positions of ink droplets ejected by the printhead 201, an ink droplet ejection timing is adjusted. First, a distance Xa from a position where an ink droplet is ejected during the forward direction scanning to a position where the ink droplet is landed on the recording medium 203 is expressed by the following expression.

$$Xa=(H/Va)\times Vcr$$

A distance Xb from a position where an ink droplet is ejected during the backward direction scanning to a position where the ink droplet is landed on the recording medium 203 is expressed by the following expression.

$$Xb=(H/Va)\times(-Vcr)$$

$$=-Xa$$

By the above-described expressions, an appropriate ejection timing for a position of the printhead 201 that is detected by the encoder sensor 210 is calculated based on the distance between the printhead 201 and the recording medium 203 and the ejection speed of the ink droplet detected by the droplet detection sensor 205. In the present exemplary embodiment, a default ejection speed and an ejection timing for the default ejection speed are determined in advance and stored in the memory 303. An adjustment value for an ejection timing for the default ejection speed is set to "0", and ejection timing adjustment is performed using adjustment values "−4" to "+4" in accordance with an ejection speed. The adjustment is made in units of 1200 dpi. A table in which ejection speeds and ejection timing adjustment values are associated with each other is stored in the memory 303. An ejection timing adjustment value in accordance with an ejection speed acquired in the ejection speed calculation processing illustrated in FIG. 7 to be described below is acquired from the table, and the ejection timing is adjusted.

Figure 4B:
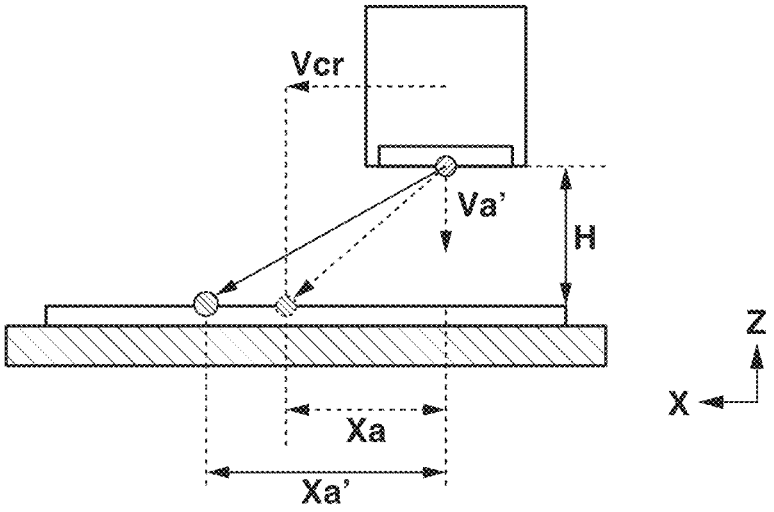

FIG. 4B illustrates a case where an ejection speed of an ink droplet detected by the droplet detection sensor 205 is decreased from the ink droplet ejection speed illustrated in FIG. 4A described above. In this case, a distance Xa' from a position where an ink droplet is ejected during the forward direction scanning to a position where the ink droplet is landed on the recording medium 203 is expressed by the following expression.

$$Xa'=(H/Va')\times Vcr$$

If an ejection speed of the ink droplet that is ejected from the printhead 201 and is landed on the recording medium 203 is attenuated by 10%, a distance from the ejection position to the landing position can be calculated by the following expression.

$$Xa'=(H/Va')\times Vcr$$

$$=(H/(Va\times 0.9))\times Vcr$$

$$=1.11\times Xa$$

As described above, in a case where an ejection speed is decreased, the landing position deviates in the scanning direction of the printhead 201. By obtaining the distance from the ejection position to the landing position, an appropriate ejection timing adjustment value can be obtained based on the ejection speed, like in FIG. 4A. In the present exemplary embodiment, the thickness of the recording medium 203 is sufficiently small, and thus a distance between the ejection port surface 201*a* of the printhead 201 and the recording medium 203 can be regarded to be equal to a distance between the ejection port surface 201*a* and the platen 212.

Next, a method for calculating an ejection speed of an ink droplet ejected from the printhead 201 according to the present exemplary embodiment will be described with reference to FIGS. 5A to 5D. FIGS. 5A to 5D are schematic sectional views each illustrating the printhead 201 and the droplet detection sensor 205 when the printing apparatus 100 is taken along a Y-Z plane. FIGS. 5A to 5D also illustrate timing diagrams each illustrating an ejection signal for applying a driving pulse to the printhead 201 and a detection signal obtained when the droplet detection sensor 205 detects a passage of an ink droplet.

As illustrated in FIG. 5A, the printhead 201 includes the ejection port surface 201*a*. The droplet detection sensor 205 includes the light-emitting element 401, the light-receiving element 402, and the control circuit board 403. The light-emitting element 401 emits light 404, and the light-receiving element 402 receives the light 404 emitted from the light-emitting element 401. The control circuit board 403 detects the amount of light received by the light-receiving element 402. Since the amount of received light decreases as the ink droplet passes through the light 404, the passage of the ink droplet can be detected. The droplet detection sensor 205 is disposed such that an optical axis of the light 404 is arranged at the same position in the Z-direction on the surface of the platen 212 where the recording medium 203 is supported. A slit is formed in the vicinity of each of the light-emitting element 401 and the light-receiving element 402 so that the light 404 to be incident is narrowed down, which improves a signal to noise (S/N) ratio. A positional relationship between the printhead 201 and the droplet detection sensor 205 in the X-direction in which an ink droplet can be ejected to pass through the light 404 is a positional relationship for detection. In ink droplet detection to calculate an ejection speed of an ink droplet, the sequence control unit 307 causes the sensor/motor control unit 302 to control the carriage motor 208, to cause the printhead 201 to move to a position in the positional relationship for detection. A light beam sectional area of the light 404 according to the present exemplary embodiment is about 1 ($mm^2$). A parallel light projection area of the ink droplet that has passed through the light 404 is about $2^{-3}$ ($mm^2$).

FIG. 5A illustrates a state where a distance in a height direction (Z-direction) between the ejection port surface 201*a* of the printhead 201 and the light 404 emitted from the light-emitting element 401 corresponds to a distance H1. In a case where the distance between the ejection port surface 201*a* and the light 404 does not correspond to the distance H1, the sensor/motor control unit 302 drives the lift motor 211 to cause the lift cam to move the printhead 201 in the height direction. In the state illustrated in FIG. 5A, an ejection signal from the head control unit 310 in the CPU 301 is transmitted to the head control circuit 305 via the driver unit 306. The driver unit 306 transmits a timing of when the ejection signal is transmitted to the sequence control unit 307. The head control circuit 305 generates a driving pulse according to the ejection signal, and applies the driving pulse to the printhead 201, to cause the printhead 201 to eject ink from the ejection port. In a case where an ink droplet passes through the light 404 emitted from the light-emitting element 401 and the amount of light received by the light-receiving element 402 is changed, the control circuit board 403 outputs a timing of when the amount of received light is changed as a detection signal. The output detection signal is sent to the sequence control unit 307 via the sensor/motor control unit 302. Further, the sequence control unit 307 detects a detection period T1 from when the ejection signal is generated until when the detection signal is output. As described above, the sequence control unit 307 functions as a period detection unit that detects a period from when ejection of an ink droplet is started until when the ejected ink droplet is detected, and detects a detection period for calculating an ejection speed.

Figure 5B:
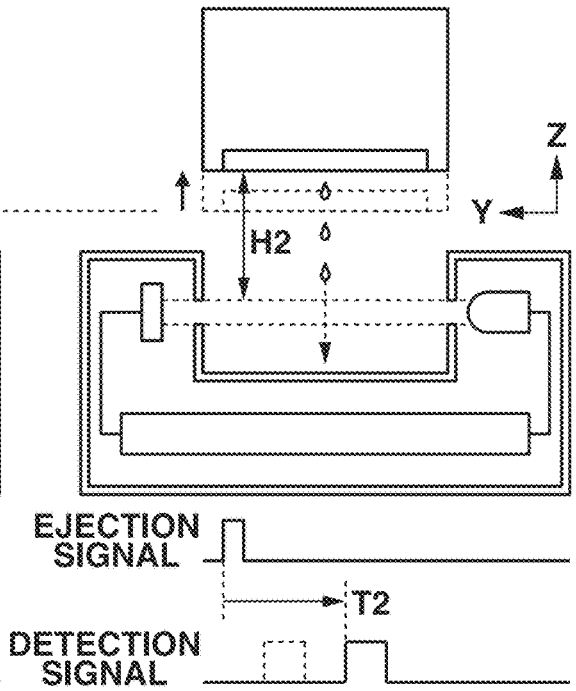

FIG. 5B illustrates a state where the lift motor 211 is driven after the ink droplet is detected in FIG. 5A and the distance in the height direction (Z-direction) between the ejection port surface 201*a* of the printhead 201 and the light 404 emitted from the light-emitting element 401 corresponds to a distance H2. Like in FIG. 5A, a timing of when the amount of light received by the light-receiving element 402 is changed by an ink droplet passing through the light 404 of the droplet detection sensor 205 is output as a detection signal. Then, a detection period T2 from when the ejection signal for causing the printhead 201 to eject an ink droplet is generated until when the detection signal is output is detected by the sequence control unit 307.

After the detection periods T1 and T2 are detected in the states illustrated in FIGS. 5A and 5B, respectively, the sequence control unit 307 calculates an ejection speed V1 of the ink droplet passing a distance between the distance H2 and the distance H1 based on a difference between the detection period T1 and the detection period T2 and a difference between the distance H1 and the distance H2. The ejection speed V1 is calculated by the following expression.

$$V1=(H2-H1)/(T2-T1)$$

Figure 5C:
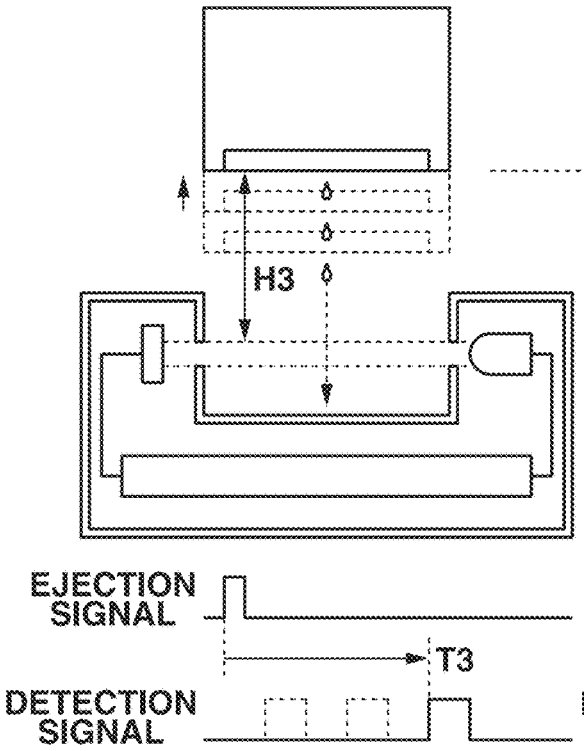

After the ejection speed V1 is calculated, the lift motor 211 is driven to move the ejection port surface 201*a* and the light 404 to be spaced apart from each other in the height direction by a distance H3 that is longer than the distance H2. This state is illustrated in FIG. 5C. Like in FIGS. 5A and 5B, the control circuit board 403 detects, as a detection signal, a timing of when the amount of light is changed by an ejected ink droplet passing through the light 404 of the droplet detection sensor 205 after the ink droplet is ejected from the ejection port of the printhead 201. Then, a detection period T3 from when an ejection signal for causing the printhead 201 to eject the ink droplet is generated until when the detection signal is output is detected by the sequence control unit 307. In the same manner as described above with reference to FIGS. 5A and 5B, an ejection speed V2 of the ink droplet passing a distance between the distance H3 and the distance H2 is calculated based on a difference between the detection period T2 and the detection period T3 detected at the distance H2 and the distance H3, respectively, and a difference between the distance H2 and the distance H3. The ejection speed V2 is calculated by the following expression.

$$V2=(H3-H2)/(T3-T2)$$

Figure 5D:
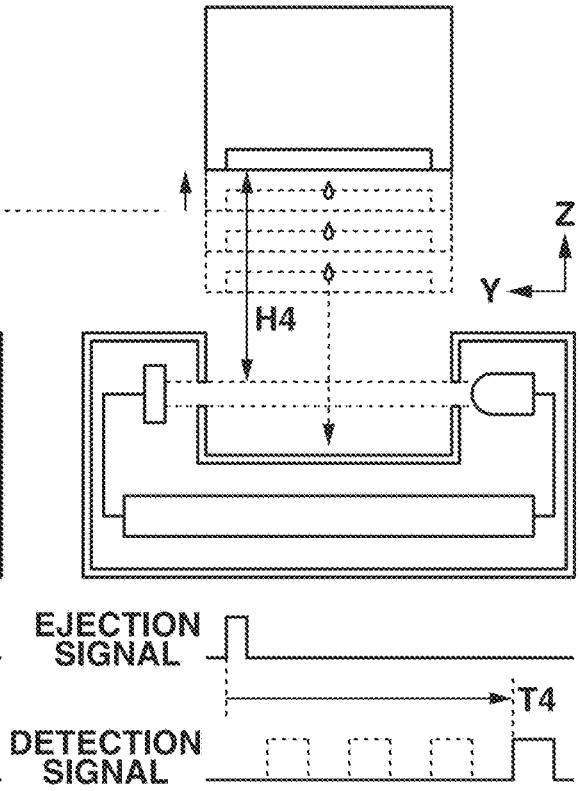

After the ejection speed V2 is calculated, the lift motor 211 is further driven to move the ejection port surface 201*a* and the light 404 to be spaced apart from each other in the height direction by a distance H4 that is longer than the distance H3. This state is illustrated in FIG. 5D. Like in FIGS. 5A, 5B, and 5C, the control circuit board 403 detects a timing of when the amount of light is changed by an ejected ink droplet passing through the light 404 of the droplet detection sensor 205 after the ink droplet is ejected from the ejection port of the printhead 201, and outputs a detection signal. Then, a detection period T4 from when an ejection signal for causing the printhead 201 to eject the ink droplet is generated until when the detection signal is output is detected by the sequence control unit 307. In the same manner as described above with reference to FIGS. 5A to 5C, an ejection speed V3 of the ink droplet passing a distance between the distance H4 and the distance H3 is calculated based on a difference between the detection period T3 and the detection period T4 detected at the distance H3 and the distance H4, respectively, and a difference between the distance H3 and the distance H4. The ejection speed V3 is calculated by the following expression.

$$V3=(H4-H3)/(T4-T3)$$

As described above, the distance between the printhead 201 and the droplet detection sensor 205 is changed and the detection period at each distance is detected, to calculate the ejection speed V of an ink droplet. The present exemplary embodiment described above illustrates an example where detection periods are detected in ascending order of distance. However, the detection order is not limited to this example. For example, detection periods may be detected in descending order of distance. In the present exemplary embodiment, the distance H is in a range from 1.2 mm to 2.2 mm.

The distance between the printhead 201 and the droplet detection sensor 205 is not limited to the above-described four distances. The detection periods may be measured with more than four distances and the ejection speeds may be calculated based on the measured detection periods. In that case, ejection speeds corresponding to more distances can be calculated, and thus an influence on attenuation of the ejection speed (whether the ejection speed is constant or changes) can be acquired more precisely. As a result, an ink droplet ejection speed and an influence on attenuation can be acquired with higher accuracy. The detection period may be measured with distances fewer than four, e.g., one distance, and an ejection speed may be calculated using a measured detection period. In that case, a time for detection period measurement can be reduced.

Figure 6A:
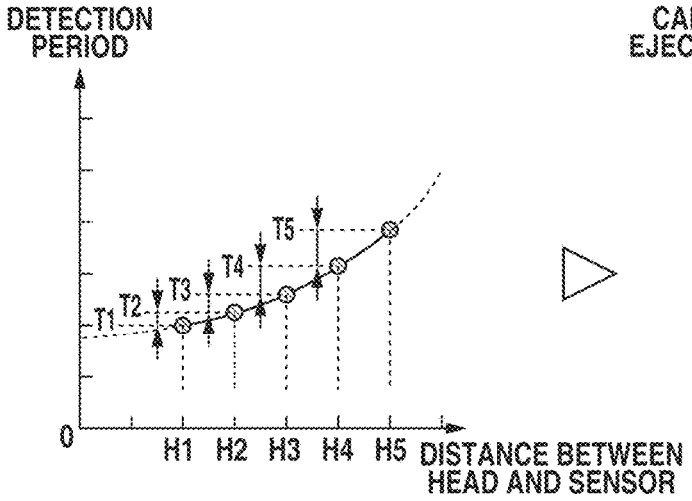
FIGS. 6A, 6B, 6C, and 6D are graphs illustrating a detection period and an ejection speed according to the exemplary embodiment.
Figure 6B:
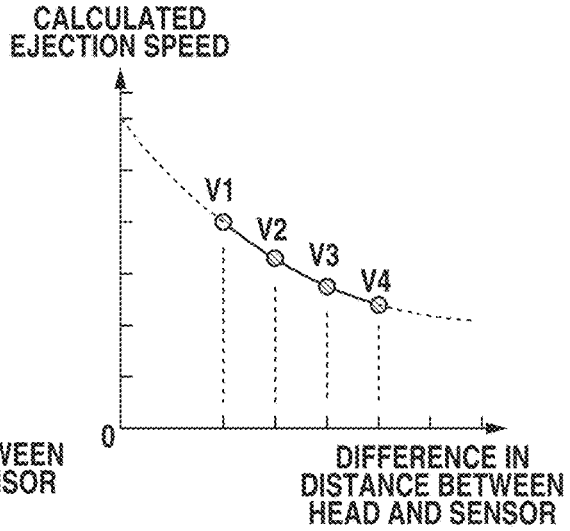
Figure 6C:
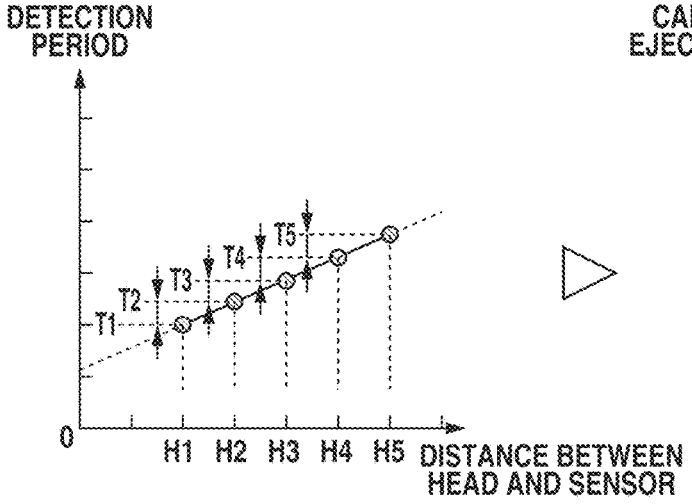
Figure 6D:
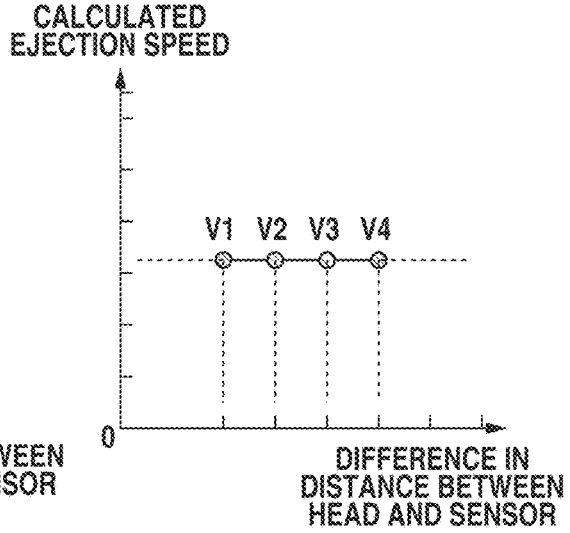

FIGS. 6A and 6C are graphs each illustrating the distance between the ejection port surface 201*a* and the light 404 of the droplet detection sensor 205 and the detection period output result at each distance as described above with reference to FIGS. 5A to 5D. FIGS. 6B and 6D are graphs each illustrating a relationship between the ejection speed calculated based on the distances and the detection periods illustrated in FIGS. 6A and 6C and the difference between the distances.

In the graph illustrated in FIG. 6A, the vertical axis represents the detection period detected by the sequence control unit 307, and the horizontal axis represents the distance between the ejection port surface 201*a* of the printhead 201 and the light 404 of the droplet detection sensor 205. Points represented by hatched circles in FIG. 6A correspond to actually measured points. In the present exemplary embodiment, the detection periods are detected at distances H1 to H5, respectively. The distance H5 is further away from the distance H4.

In the graph illustrated in FIG. 6B, the vertical axis represents the ejection speed, and the horizontal axis represents the difference between distances. Data that transitions non-linearly due to various effects can be obtained as calculated ejection speed data. Accordingly, an approximate curve representing an expression composed of two or more terms is obtained based on the acquired ejection speed data, to more accurately calculate the ejection speed data for each difference between distances, and the two or more terms in the obtained approximate curve are used as an expression representing an ejection speed. To obtain the approximate curve, three or more ejection speeds are used. To calculate three or more ejection speeds, it may be desirable to detect detection periods at four or more distances. The method for calculating ejection speeds is described above.

The inventors of the present disclosure have experimentally confirmed that there is a possibility that data that transitions linearly can be obtained depending on individual differences of printheads, differences in physical properties between ink colors, and the use status and environmental impacts. FIG. 6C illustrates an example of data that transitions linearly. Also, in this case, an ejection speed can be calculated based on a detection period at each distance and a difference in the distance between the ejection port surface 201*a* and the light 404 in the same manner as described above. FIG. 6D illustrates a relationship between the calculated ejection speed and the difference between distances. As illustrated in FIG. 6D, the ejection speed calculated based on the difference between distances is constant at any difference between distances. In a case where it is obvious that data that transitions linearly can be obtained, the ejection speed is constant regardless of the distance, and thus it is sufficient to obtain a single ejection speed. To calculate a single ejection speed, detection periods at two distances may be detected.

Even in a case where an ejection speed transitions non-linearly, the approximate curve may not be calculated in the case of performing printing only when the distance between the ejection port surface 201*a* and the recording medium 203 is constant. In this case, detection periods at two distances, including the distance for printing, may be detected.

Figure 7:
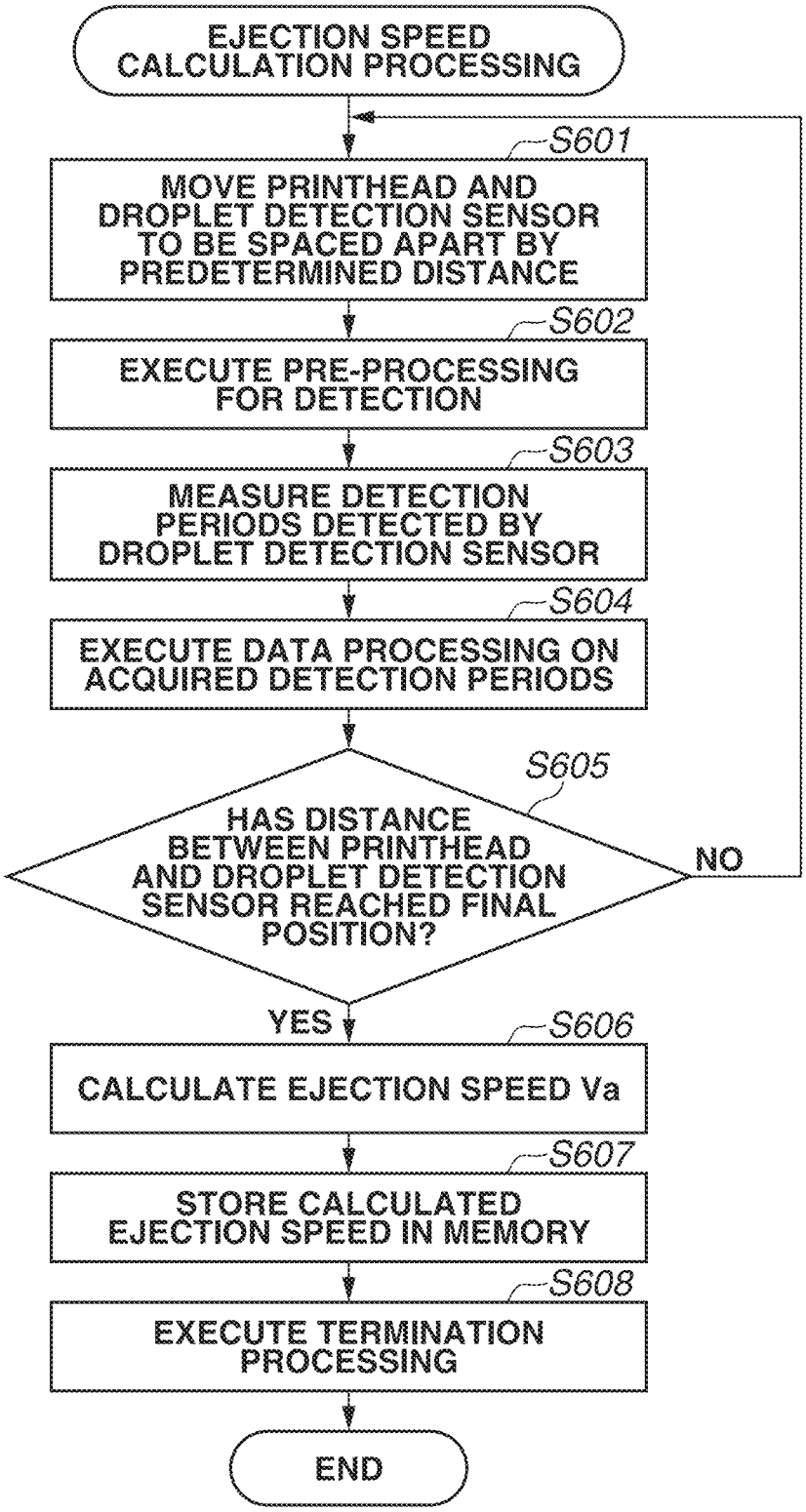
FIG. 7 is a flowchart illustrating ejection speed calculation processing according to the exemplary embodiment.

FIG. 7 is a flowchart illustrating ejection speed calculation processing corresponding to FIGS. 5A to 5D and FIGS. 6A to 6D.

The ejection speed calculation processing illustrated in FIG. 7 is processing that is executed, for example, when a user of the printing apparatus 100 first operates the printing apparatus 100 in an initial installation operation, or when the printhead 201 is replaced with a new printhead and the new printhead is mounted. This processing is also performed at a timing that is determined in measurement timing determination processing to be described below. The processing illustrated in FIG. 7 is processing that is executed by the sequence control unit 307 of the CPU 301, based on, for example, programs stored in the memory 303.

First, in step S601, the sequence control unit 307 drives the lift motor 211 to cause the printhead 201 and the droplet detection sensor 205 to be spaced apart from each other by a predetermined distance. Distances by which the printhead 201 and the droplet detection sensor 205 are spaced apart from each other are preliminarily set in the memory 303. In the present exemplary embodiment, the distances H1 to H4 described above with reference to FIGS. 5A to 5D are set. As described above with reference to FIGS. 5A to 5D, the printhead 201 and the droplet detection sensor 205 are spaced apart from each other by the distances H1, H2, H3, and H4, in this order.

Next, in step S602, pre-processing for detecting an ejection speed is executed. Specific examples of pre-processing include presetting of an optimal ejection control for detecting an ejection speed, a preliminary ejection operation for stably ejecting ink droplets, and a suction fan stop operation for stabilizing an airflow control in the printing apparatus 100.

Next, in step S603, an ejection operation for ejecting ink droplets for inspection from the printhead 201 is executed to the light 404 emitted from the light-emitting element 401 of the droplet detection sensor 205. Specifically, a detection period from when the ejection of an ink droplet from a predetermined nozzle of the printhead 201 is started until when the light-receiving element 402 of the droplet detection sensor 205 detects that the ink droplet has passed through the light 404 is detected at the distance set in step S601. In this operation, as the detection period, a plurality of detection periods is detected using a plurality of nozzles of the printhead 201. The nozzles with which the detection period is measured may be desirably selected from among a wide range of nozzles, including the nozzles at both ends and the nozzle at the center, so that an ejection speed can be detected with high accuracy.

Next, in step S604, data processing is executed on the detection period acquired in step S603, and the detection period corresponding to the distance set in step S601 is calculated. Specifically, averaging processing based on a number of samples that may be desirable to stabilize the measurement of the detection period, and data processing, such as deletion of data that falls outside of upper and lower error ranges, to avoid mixture of abnormal values of data.

Next, in step S605, it is determined whether the detection period is detected for all distances set in the memory 303. In the present exemplary embodiment, it is determined whether the current distance between the ejection port surface 201*a* and the light 404 of the droplet detection sensor 205 corresponds to the distance H4 that is the final distance by which the printhead 201 and the droplet detection sensor 205 are spaced apart from each other. In a case where the current distance does not correspond to the distance H4 (NO in step S605), the processing returns to step S601 to move the droplet detection sensor 205 and the printhead 201 to be spaced apart from each other by the subsequently set distance and execute the subsequent data acquisition and processing. In step S605, in a case where it is determined that the current distance corresponds to the distance H4 (YES in step S605), it is determined that the acquisition of the detection period for all distances is completed, and then the processing proceeds to step S606.

In step S606, an ejection speed is calculated. Specifically, as described above with reference to FIGS. 5A to 5D and FIGS. 6A to 6D, an ejection speed is calculated based on the difference between distances and the detection period at each distance. After the ejection speed is calculated, the processing proceeds to step S607. In step S607, information about the ejection speed calculated in step S606 is stored in the memory 303. The ejection speed information stored in this operation is used for subsequent data processing and driving control processing for the printhead 201 in accordance with the required processing.

Next, in step S608, termination processing is executed. Specifically, since the calculation of the ejection speed is completed, the printhead 201 is retracted to a predetermined position, or the processing shifts to a standby state for subsequent printing operation processing, and the processing further shifts to cleaning processing or the like for the printhead 201, based on the acquired ejection speed information, and then the processing is terminated.

After the ejection speed calculation processing illustrated in FIG. 7 is terminated, the table in which the ejection speeds preliminarily stored in the memory 303 are associated with adjustment values for ejection timings is acquired and the ejection timing adjustment value is acquired from the table, based on the ejection speed acquired in the processing illustrated in FIG. 7, and then ejection timing adjustment processing is executed. In the case of printing an image, the timing control unit 309 controls the timing of ejecting ink based on print data.

The surrounding environment where the printing apparatus is installed and the usage thereof vary from user to user. Depending on the surrounding environment and the usage, changes in the ink droplet ejection speed of the printhead 201 vary even if the same number of dots is ejected. In the present exemplary embodiment, the timing for measuring the detection period to calculate the ejection speed next is determined based on a change in the ejection speed.

Figure 8:
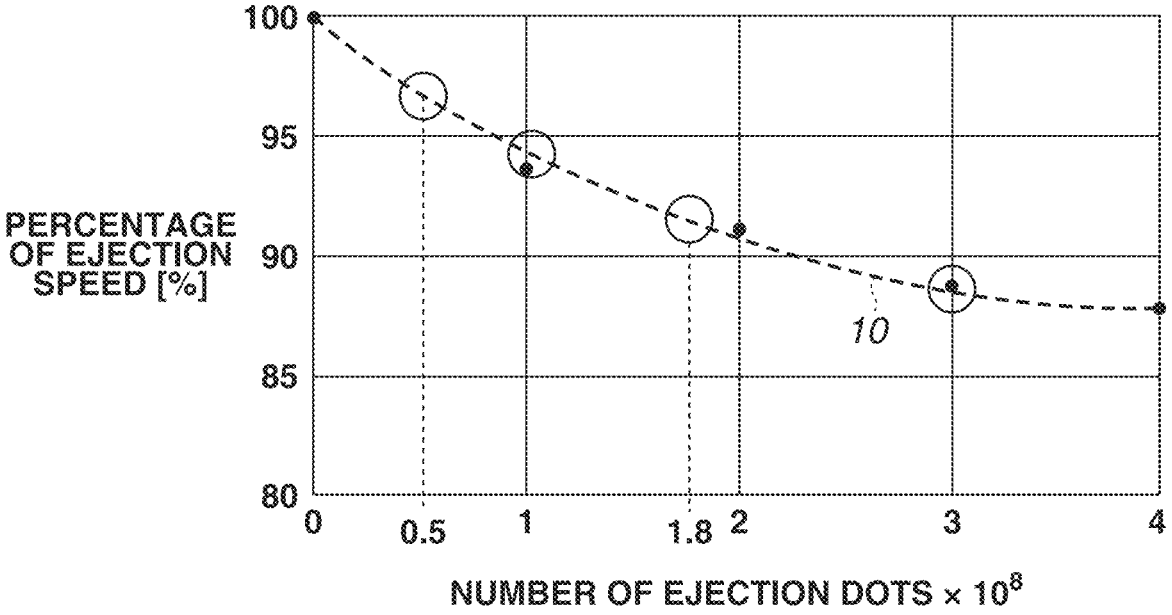
FIG. 8 is a diagram illustrating a relationship between the number of ejection dots and an ejection speed.

FIG. 8 is a graph illustrating a relationship between the number of ejection dots and the ejection speed. The horizontal axis of the graph indicates the number of ejection dots, and the vertical axis indicates a percentage of the ejection speed where the ejection speed at the time of attachment of the printhead is 100%. Each point in the graph indicates the ejection speed calculated based on the detection period detected by the droplet detection sensor 205, as a percentage, and a dotted line 10 indicates an approximate curve of the ejection speed. As illustrated in FIG. 8, the ejection speed decreases as the number of ejection dots increases. When the ejection speed changes by a certain amount or more, and in a case where image recording is performed based on the ejection timing set before the change in the ejection speed, the quality of the image can decline because of a misalignment of the landing position. Therefore, in the present exemplary embodiment, the ejection speed calculation processing in FIG. 7 is performed at the timing of when the ejection speed is estimated to have changed by a predetermined amount. For example, the ejection speed is to be calculated each time the ejection speed attenuates by 3%, when the ejection speed attenuates in the manner illustrated in FIG. 8. First, when the printhead 201 is attached (the number of ejection dots is 0), the ejection speed is calculated (the first time). Afterward, the ejection speed calculation processing is performed at the timing of when the following number of dots is ejected, which is the timing of when the ejection speed attenuates by 3% with respect to 100%. Black circles in FIG. 8 indicate the timings of the ejection speed calculation processing for the second to fifth times.

Second time (a speed of 97%): 0.5×10e8
Third time (a speed of 94%): 1×10e8
Fourth time (a speed of 91%): 1.8×10e8
Fifth time (a speed of 88%): 3×10e8

As illustrated in FIG. 8, in a case where the change of the ejection speed becomes gentle as the number of ejection dots increases, the interval between executions of the ejection speed calculation processing gradually increases. Changes of the ejection speed vary depending on the structure of the printhead or the composition of the ink. In the present exemplary embodiment, the timing determination processing is performed based on the attenuation of the ejection speed illustrated in FIG. 8. The memory 303 stores beforehand a table in which each of the timings for the second to fifth times in FIG. 8 and the ejection speed in the case of the attenuation at an estimated attenuation rate (here, 3%) between the timings are set. In the present exemplary embodiment, the ejection speed at 100% is 10 m/s. The ejection speed calculation processing is performed at the timing stored in the table. FIG. 11A illustrates the table of the present exemplary embodiment.

Figure 9:
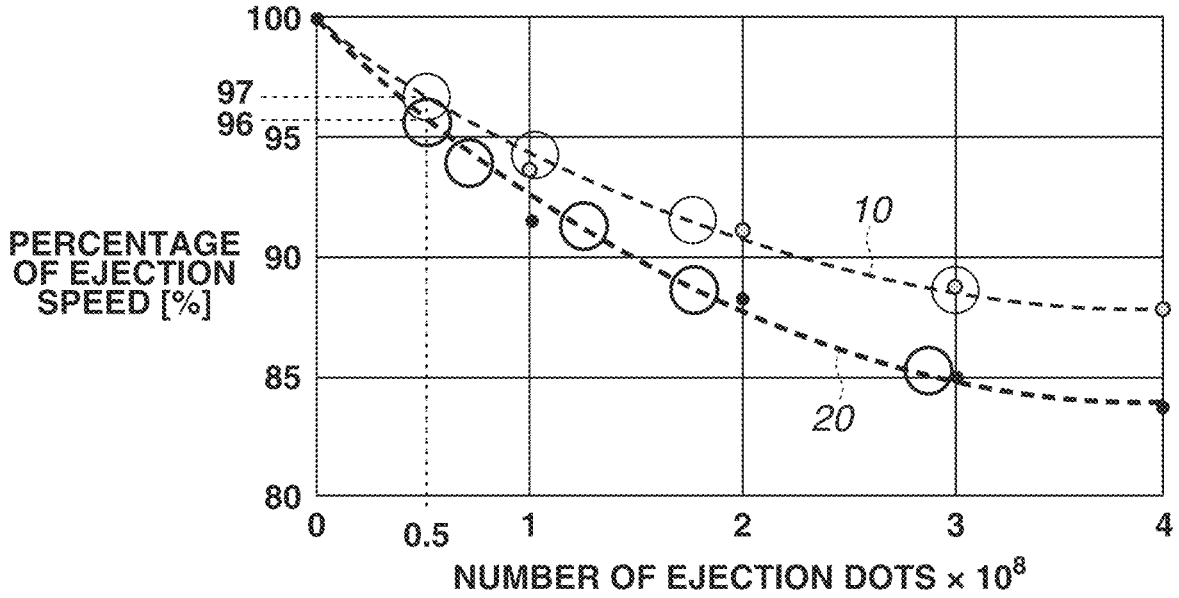
FIG. 9 is a diagram illustrating a relationship between the number of ejection dots and an ejection speed.

However, as described above, changes of the ejection speed vary depending on the surrounding environment and the usage of the printing apparatus. Therefore, timings set in the table beforehand can be inappropriate. FIG. 9 illustrates a case where an attenuation rate of the ejection speed with respect to the number of ejection dots is larger than that in the case illustrated in FIG. 8. The dotted line 10 illustrated also in FIG. 8 indicates the approximate curve of the estimated speed, and a dotted line 20 indicates an approximate curve in a case where the attenuation rate is larger than that of the estimated speed. An attenuation rate of the ejection speed calculated the second time with respect to the ejection speed calculated the first time is 3% for the ejection speed of the dotted line 10, and 4% for the ejection speed of the dotted line 20. In such a case, i.e., in a case where the attenuation of the ejection speed is faster than estimated, it may be desirable to perform the next ejection speed calculation processing at a stage where the number of ejection dots is less than that for the timing stored in the table, in order to execute the ejection speed calculation processing at the timing of when the ejection speed has attenuated by 3%. Thus, in a case where the ejection speed calculated in the ejection speed calculation processing has attenuated more than the estimated speed stored in the table by a predetermined value or more, the table is revised to change the timing for performing the next ejection speed calculation processing. In a case where the ejection speed calculated the second time is 9.6 m/s that is 96%, and the attenuation rate is 4% as indicated by the dotted line 20 in FIG. 9, the table is revised so that the ejection speed calculation processing is to be performed next when the number of ejection dots is 0.75×10e8. In the present exemplary embodiment, the number of ejection dots for the timing for performing the next ejection speed calculation processing is determined by the following equation:

Number of ejection dots for next timing=Number of ejection dots at this timing stored in table+(Number of ejection dots for next timing stored in table−Number of ejection dots at this timing)/{(Ejection speed calculated this time−Ejection speed to be calculated at next timing stored in table based on speed calculated this time)×(Ejection speed calculated this time−Estimated speed for next timing stored in table)}.

FIG. 11C illustrates "Ejection speed to be calculated at next timing stored in table based on speed calculated this time". With the assumption that the ejection speed also attenuates at the subsequent timing and thereafter by the same amount as that of the ejection speed calculated this time (the second time), 9.2 m/s that is the result of the attenuation by 0.4 m/s from the ejection speed of 9.6 m/s calculated this time is the ejection speed to be calculated at the next timing. Applying the above-described example to the equation results in the following:

$$(0.5\times10e8)+(1\times10e8-0.5\times10e8)/\{(9.6-9.2)/(9.6-9.4)\}=0.75\times10e8.$$

Similarly, the number of ejection dots corresponding to the timing for performing the ejection speed calculation processing for the fourth time and thereafter is also calculated and the table is revised. FIG. 11B illustrates the revised table.

In this way, the timing for performing the ejection speed calculation processing is determined. While the case where the actual ejection speed attenuates faster than estimated is described above as an example, this is also applicable to a case where the actual ejection speed attenuates slower than estimated. In that case, the timing for performing the ejection speed calculation processing can be slower than the timing stored in the table.

Figure 10:
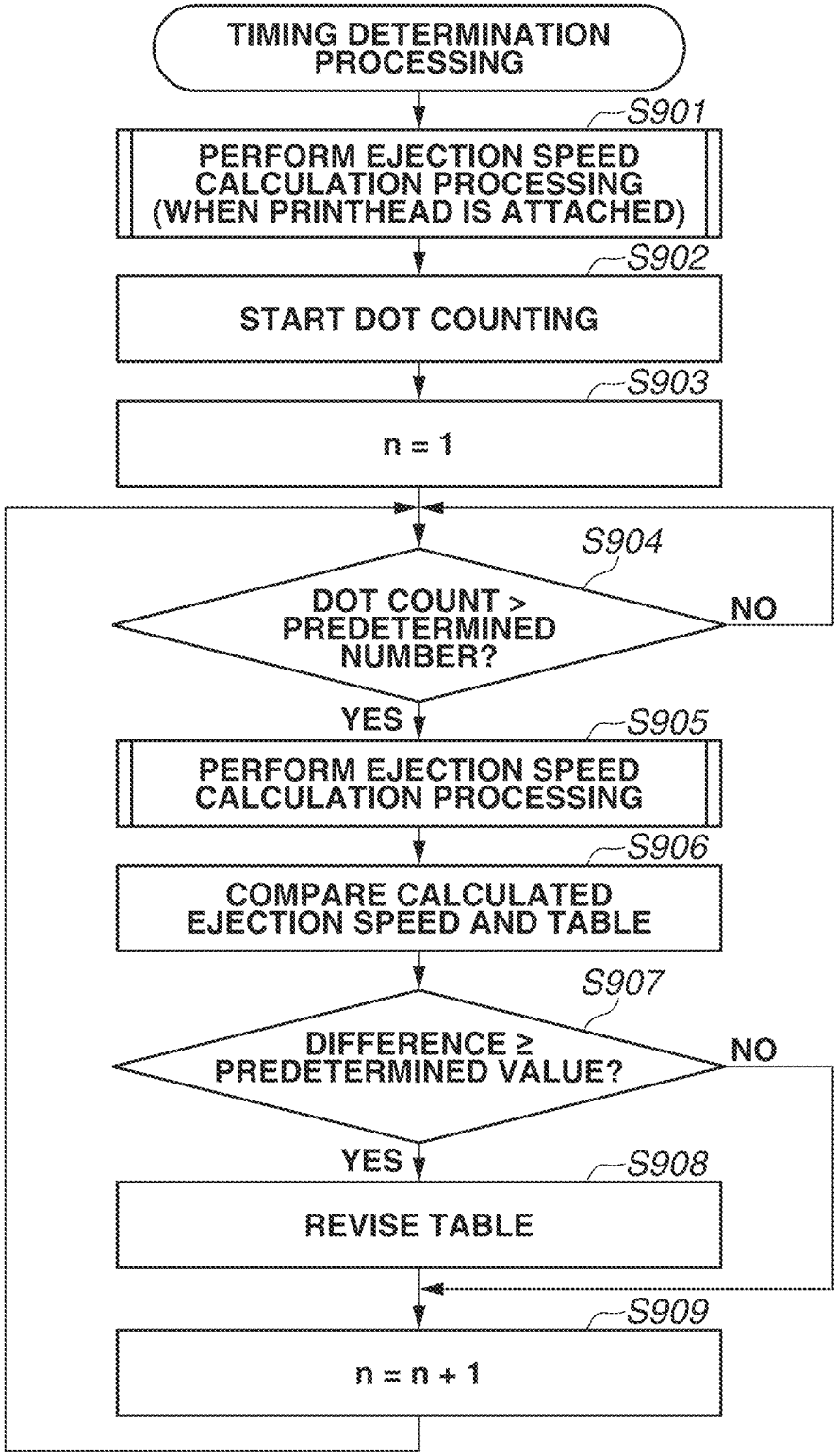
FIG. 10 is a flowchart illustrating processing of determining a timing for executing ejection speed calculation processing.

FIG. 10 illustrates a flowchart of processing for determining the timing for performing the ejection speed calculation processing. The processing in FIG. 10 begins when a new printhead for replacement is attached to the printing apparatus 100 as the printhead 201. The sequence control unit 307 of the CPU 301 performs this processing, based on a program stored in, for example, the memory 303.

First, in step S901, the sequence control unit 307 performs the ejection speed calculation processing in FIG. 7, and calculates the ejection speed at the time of when the printhead 201 is attached.

Next, in step S902, the sequence control unit 307 starts dot counting. The sequence control unit 307 hereafter counts the number of ejection dots ejected from the printhead 201 in image recording and the like. The sequence control unit 307 stores the counted number of ejection dots into the memory 303. While, in the present exemplary embodiment, the number of ejection dots ejected during the ejection speed calculation processing is not counted, the number of ejection dots ejected during the ejection speed calculation processing may also be counted.

In step S903, the sequence control unit 307 sets n=1.

In step S904, the sequence control unit 307 determines whether the dot count is more than a predetermined number. The predetermined number is the number of ejection dots which is indicated in the table stored in the memory 303 and at which the next ejection speed calculation processing is performed. This is the dot count in a column n in FIG. 11A, and is 0.5×10e8 in the case of n=1. The dot counting continues until the dot count exceeds the predetermined number.

In a case where the sequence control unit 307 determines that the dot count is more than the predetermined number (YES in step S904), the processing proceeds to step S905. In step S905, the sequence control unit 307 performs the ejection speed calculation processing in FIG. 7.

Next, in step S906, the sequence control unit 307 compares the ejection speed calculated in step S905 and the estimated speed stored in the table.

In step S907, the sequence control unit 307 determines whether a difference between the ejection speed calculated in step S905 and the estimated speed stored in the table is more than or equal to a predetermined value, as a result of the comparison in step S906. The predetermined value for the difference may be a value such as 0.5 m/s.

In a case where the difference is more than or equal to the predetermined value (YES in step S907), the processing proceeds to step S908. In step S908, the sequence control unit 307 revises the table and stores the revised table into the memory 303. The above-described equation can be used to revise the table. The actual ejection speed is illustrated in FIG. 9, and the table is revised as illustrated in FIG. 11B in a case where the attenuation rate is 4%. Subsequently, in step S909, the sequence control unit 307 increments n by 1, and the processing returns to step S904 to continue.

In a case where the difference is not more than the predetermined value (NO in step S907), the processing proceeds to step S909. In step S909, the sequence control unit 307 increments n by 1, and the processing returns to step S904 to continue.

As described above, the timing for performing the next ejection speed calculation processing can be determined based on the ejection speed calculated last time. According to the present exemplary embodiment, the ejection speed calculation processing can be performed at an appropriate timing. Performing the ejection speed calculation processing at an appropriate timing makes it possible to reset the ejection timing before the ejection speed decreases to the extent of affecting the image quality, whereby a reduction in the image quality can be prevented. In a case where the ejection speed attenuates more gently than estimated, the ejection speed calculation processing is not performed more than necessary, and thus user convenience can be prevented from being impaired by the time taken to perform the ejection speed calculation processing.

While, in the above-described exemplary embodiment, the estimated ejection speed and the actual ejection speed are compared, the attenuation rates may be compared instead of the ejection speed. In that case, the attenuation rate is stored in the table, and the timing for performing the ejection speed calculation processing next and thereafter may be determined based on a result of comparing the attenuation rate stored in the table and the attenuation rate obtained based on the speed calculated before.

The ejection speed calculation processing in FIG. 7 can be performed based on a user instruction. In a case where the processing in FIG. 7 is performed based on the user instruction, the table may be revised by setting the estimated timing for occurrence of attenuation by 3% from the timing of the ejection speed calculation processing as the next timing.

Figure 12:
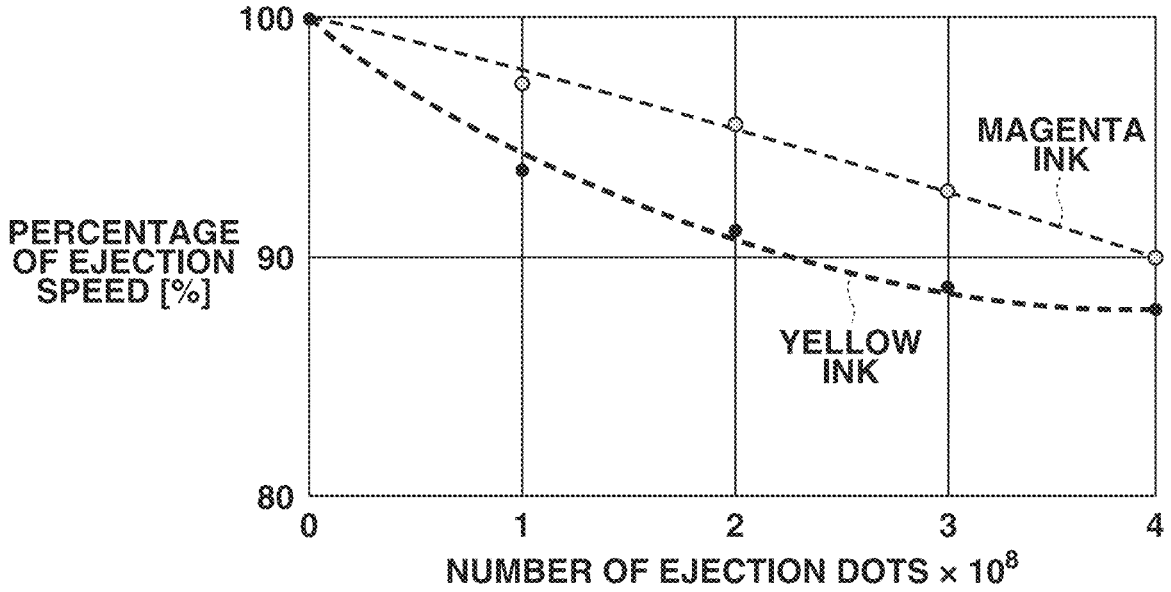
FIG. 12 is a diagram illustrating a relationship between the number of ejection dots and an ejection speed for each ink color.

Attenuation of the ejection speed can vary depending on the color of the ink. FIG. 12 illustrates a change in the ejection speed of each of the magenta ink and the yellow ink of the present exemplary embodiment. As illustrated in FIG. 12, the ejection speed of the magenta ink linearly changes, and the degree of attenuation of the yellow ink decreases as the number of ejection dots increases. In addition, the degree of attenuation of the magenta ink is smaller than that of the yellow ink. In a case where attenuation of the ejection speed vary depending on the color of the ink, the table for the ejection speed calculation processing may be held for each of the colors. Further, the timing for performing the ejection speed calculation processing may be determined based on the color of the ink of which the ejection speed attenuates most easily among the colors or may be determined based on an average attenuation among the colors.

The timing for performing the ejection speed calculation processing set for an ejection head used in the past may be set as the timing for performing the ejection speed calculation processing for a newly attached ejection head. For example, in a case where an attenuation curve of the printhead attached last time is the dotted line 20 in FIG. 9, the timing for performing the second ejection speed calculation processing for the currently attached printhead can be determined based on this attenuation curve, and the determined timing can be stored in the table. The table is then revised based on the actual ejection speed of the new printhead.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

The timing for performing the next ejection speed calculation processing is determined based on the ejection speed calculated in the ejection speed calculation processing performed prior to the timing for performing the next ejection speed calculation processing, whereby the ejection speed can be calculated at an appropriate timing.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-115059, filed Jul. 2, 2020, which is hereby incorporated by reference herein in its entirety.

What is claimed is:

1. An ejection apparatus comprising:

an ejection head configured to eject a droplet from an ejection port on an ejection port surface;

a droplet detection unit configured to detect arrival of the droplet ejected from the ejection port at a predetermined position;

an acquisition unit configured to acquire information about an ejection speed that is a moving speed of the droplet detected by the droplet detection unit; and a determination unit configured to determine subsequent timings for acquiring information about an ejection speed by the acquisition unit, based on the ejection speed acquired by the acquisition unit at a preceding timing of the subsequent timings.

2. The ejection apparatus according to claim 1, further comprising:

a storage unit configured to store information about an estimated ejection speed that is estimated to be acquired at a timing for acquiring information about an ejection speed by the acquisition unit, wherein the determination unit determines the subsequent timings, based on the estimated ejection speed stored in the storage unit and corresponding to the preceding timing, and the ejection speed indicated in the information acquired by the acquisition unit at the preceding timing.

3. The ejection apparatus according to claim 2, wherein the storage unit stores a plurality of timings for acquiring information about an ejection speed by the acquisition unit and an estimated ejection speed that is estimated to be acquired at each of the plurality of timings, and wherein the determination unit determines the subsequent timings for acquiring information about an ejection speed by the acquisition unit at a timing corresponding to the estimated ejection speed, based on the ejection speed indicated in the information acquired by the acquisition unit at the preceding timing, and stores the determined subsequent timings into the storage unit.

4. The ejection apparatus according to claim 1, wherein the determination unit determines the subsequent timings, based on an attenuation rate obtained from the ejection speed indicated in the information acquired by the acquisition unit at the preceding timing.

5. The ejection apparatus according to claim 4, further comprising a storage unit configured to store an attenuation rate of an estimated ejection speed that is estimated to be acquired at the subsequent timings, wherein the determination unit determines the subsequent timings, based on the attenuation rate stored in the storage unit and an attenuation rate of the ejection speed indicated in the information acquired by the acquisition unit with respect to a previously acquired ejection speed.

6. The ejection apparatus according to claim 1, wherein the determination unit determines a timing for acquiring information about an ejection speed by the acquisition unit at a timing following the preceding timing, based on the ejection speed indicated in the information acquired by the acquisition unit at the preceding timing.

7. The ejection apparatus according to claim 1, wherein the determination unit determines a timing for acquiring information about an ejection speed by the acquisition unit, using the ejection head currently attached to the ejection apparatus, based on an ejection speed acquired by the acquisition unit for an ejection head last attached to the ejection apparatus.

8. The ejection apparatus according to claim 1, wherein the ejection head ejects inks of a plurality of colors, and wherein the determination unit determines the subsequent timings for each of the plurality of colors of the inks.

9. The ejection apparatus according to claim 1, further comprising:

a period detection unit configured to detect a period from when the ejection head starts ejection of the droplet until when the droplet detection unit detects arrival of the droplet at the predetermined position, wherein the acquisition unit acquires information about an ejection speed calculated based on the period detected by the period detection unit.

10. The ejection apparatus according to claim 9, wherein the acquisition unit acquires the ejection speed of the droplet, based on the period detected by the period detection unit, and a distance between the ejection port surface having the ejection port and the predetermined position.

11. The ejection apparatus according to claim 10, further comprising:

a change unit configured to change a distance in a distance relationship between the ejection port surface of the ejection head and the detection unit, wherein the detection unit detects, in a state where the distance between the ejection port surface of the ejection head and the detection unit is a first distance, a first period from when ejection of a droplet from the ejection port is started until when the droplet detection unit detects the droplet, and detects, in a state where the distance between the ejection port surface of the ejection head and the detection unit is changed by the change unit to a second distance different from the first distance, a second period from when ejection of a droplet from the ejection port is started until when the droplet detection unit detects the droplet, and wherein the acquisition unit calculates the ejection speed of the droplet, based on the first distance, the second distance, the first period, and the second period.

12. The ejection apparatus according to claim 11, wherein the acquisition unit calculates the ejection speed of the droplet, based on a difference between the first distance and the second distance, and a difference between the first period and the second period.

13. The ejection apparatus according to claim 1, further comprising:

a detection unit including a light emitter and a light receiver, the light emitter emitting light, the light receiver receiving the light emitted by the light emitter, wherein the droplet detection unit detects arrival of the droplet ejected from the ejection port at the predetermined position based on an amount of the light received by the light receiver.

14. The ejection apparatus according to claim 1, further comprising:

an ejection signal generation unit configured to generate an ejection signal; and a driving pulse generation unit configured to generate a driving pulse for ejecting the droplet from the ejection port of the ejection head, based on input of the ejection signal, wherein the ejection head ejects the droplet from the ejection port by application of the driving pulse, and wherein the period detection unit detects a period, using an input timing of the ejection signal from the ejection signal generation unit to the driving pulse generation unit as a timing of when ejection of the droplet from the ejection port is started.

15. A method of acquiring an ejection speed of a droplet, the method comprising:

ejecting a droplet from an ejection port of an ejection head;

detecting arrival of the droplet ejected from the ejection port at a predetermined position;

acquiring information about an ejection speed that is a moving speed of the droplet detected in the detecting; and determining subsequent timings for acquiring information about the ejection speed, based on the ejection speed acquired at a preceding timing of the subsequent timings.

16. The method according to claim 15, further comprising:

acquiring an estimated ejection speed that is estimated to be acquired at a timing for acquiring information about the ejection speed, wherein the subsequent timings are determined based on the acquired estimated ejection speed corresponding to the preceding timing and the ejection speed acquired at the preceding timing.

* * * * *